US010680371B1

(12) United States Patent
Williams et al.

(10) Patent No.: US 10,680,371 B1
(45) Date of Patent: Jun. 9, 2020

(54) CONNECTOR ASSEMBLY

(71) Applicant: MOTOROLA SOLUTIONS, INC., Chicago, IL (US)

(72) Inventors: Guerin L. Williams, Sunrise, FL (US); Jody H. Akens, Weston, FL (US); Timothy Brand, Loganville, GA (US); Anthony M. Kakiel, Coral Springs, FL (US); Kevin K. Maggert, Dacula, GA (US); William Robertson, Pompano Beach, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 16/370,149

(22) Filed: Mar. 29, 2019

(51) Int. Cl.

| | |
|---|---|
| ***H01R 33/02*** | (2006.01) |
| ***H01R 13/11*** | (2006.01) |
| ***H01R 13/14*** | (2006.01) |
| ***H01R 12/72*** | (2011.01) |
| ***H01R 12/57*** | (2011.01) |
| ***H01R 13/631*** | (2006.01) |

(52) U.S. Cl.
CPC ..... *H01R 13/113* (2013.01); *H01R 12/57* (2013.01); *H01R 12/724* (2013.01); *H01R 13/14* (2013.01); *H01R 13/6315* (2013.01); *H01R 2201/00* (2013.01)

(58) Field of Classification Search
CPC ..... H01R 13/2407; H01R 12/585; H01R 13/2442; H01R 12/724; H01R 12/707; H01R 13/2435; H01R 13/113; H01R 13/14; H01R 13/6315; H01R 12/57
USPC ..... 439/225
See application file for complete search history.

(56) References Cited

U.S. PATENT DOCUMENTS

| | | | | |
|---|---|---|---|---|
| 7,575,487 | B2 | 8/2009 | Yodogawa | |
| 7,775,805 | B2 * | 8/2010 | Liao | H01R 13/2435 439/66 |
| 7,803,011 | B1 * | 9/2010 | Mai | H01R 12/707 439/500 |
| 8,192,236 | B1 * | 6/2012 | Zhu | H01R 12/724 439/627 |
| 9,761,980 | B2 * | 9/2017 | Zeng | H01R 13/2407 |
| 10,096,916 | B2 * | 10/2018 | Yoshida | H01R 12/585 |
| 2002/0048999 | A1 * | 4/2002 | Ming-Hui | H01R 13/2442 439/660 |
| 2004/0018757 | A1 | 1/2004 | Lang et al. | |
| 2014/0342577 | A1 | 11/2014 | De Bruijn | |

* cited by examiner

*Primary Examiner* — Jean F Duverne
(74) *Attorney, Agent, or Firm* — Michael Best & Friedrich LLP

(57) ABSTRACT

A connector assembly for connecting a battery to different electrical components within an electrical device includes a housing, and a plurality of sheet metal contacts coupled to and extending through the housing. The plurality of sheet metal contacts define a plurality of battery contact regions and a plurality of internal contact regions spaced form the plurality of battery contact regions. The plurality of internal contact regions physically contact the plurality of different electrical components. A first one of the plurality of internal contact regions is offset from a second one of the plurality of internal contact regions in a different spatial plane than a spatial plane of the second one of the plurality of internal contact regions.

25 Claims, 14 Drawing Sheets

CONNECTOR ASSEMBLY

BACKGROUND OF THE INVENTION

Electrical devices, including portable radios, commonly include a connector that connects a battery of the device to an electrical component within the device. As smaller electrical devices perform more complex computing, the electrical devices are drawing more current than ever before. Many devices rely on bladed connectors to pass current between a battery and an electrical component. However, the bladed connectors are attached directly to a printed circuit board, are often large and bulky, and only facilitate passing of current from the battery to a single printed circuit board. Accordingly, there is a need for an improved connector assembly.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
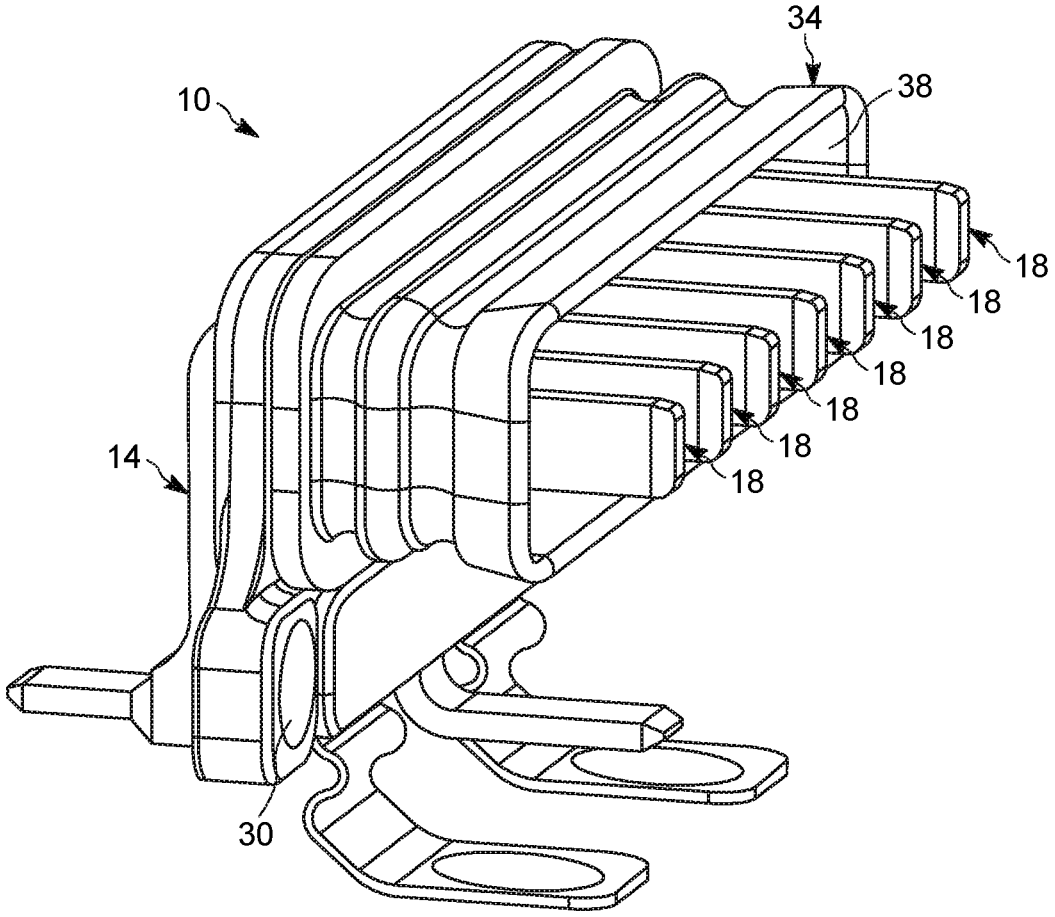
FIG. 1 is a perspective view of a connector assembly in accordance with one embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Briefly, there is provided herein an improved connector assembly. A connector assembly for connecting a battery to different electrical components within an electrical device, according to one embodiment, includes a housing, and a plurality of sheet metal contacts coupled to and extending through the housing. The plurality of sheet metal contacts define a plurality of battery contact regions and a plurality of internal contact regions spaced form the plurality of battery contact regions. The plurality of internal contact regions physically contact the plurality of different electrical components. A first one of the plurality of internal contact regions is offset from a second one of the plurality of internal contact regions in a different spatial plane than a spatial plane of the second one of the plurality of internal contact regions.

Another embodiment provides connector assembly for connecting a battery to an electrical component within an electrical device. The connector assembly includes a housing, and a two-piece sheet metal contact coupled to and extending through the housing. The two-piece sheet metal contact has a first sheet metal piece having a first thickness, a first end, and a second end. The first end of the first sheet metal piece physically connects to a battery within the electrical device. The two-piece sheet metal contact additionally has a second sheet metal piece having a second thickness that is less than the first thickness. The second sheet metal piece is welded to the second end of the first sheet metal piece. The second sheet metal piece physically connects to the electrical component within the electrical device.

FIGS. 1-14 illustrate a connector assembly 10 for connecting a battery to an electrical component within an electrical device (for example a portable radio). The connector assembly 10 includes a housing 14 and a set of sheet metal contacts 18 coupled to and extending through the housing 14. In some embodiments, the housing 14 may be overmolded directly onto the sheet metal contacts 18, and is a rigid (for example plastic) housing. As illustrated in FIGS. 2 and 3, the housing 14 may include a front side 22, and an opposite rear side 26. The housing 14 may be overmolded onto the sheet metal contacts 18 such that the sheet metal contacts 18 are not exposed along the rear side 26, but rather extend through a portion of the housing 14 and are exposed and protrude forward from the front side 22. In the illustrated embodiment, the housing 14 additionally includes at least one aperture 30 for insertion of a fastener (for example screw) to fasten the housing 14 and the connector assembly 10 overall to a another component (for example an interior housing of a portable radio). Other embodiments include different numbers and arrangements of apertures 30, as well as a housing 14 having a shape and/or size different from that illustrated.

Figure 2:
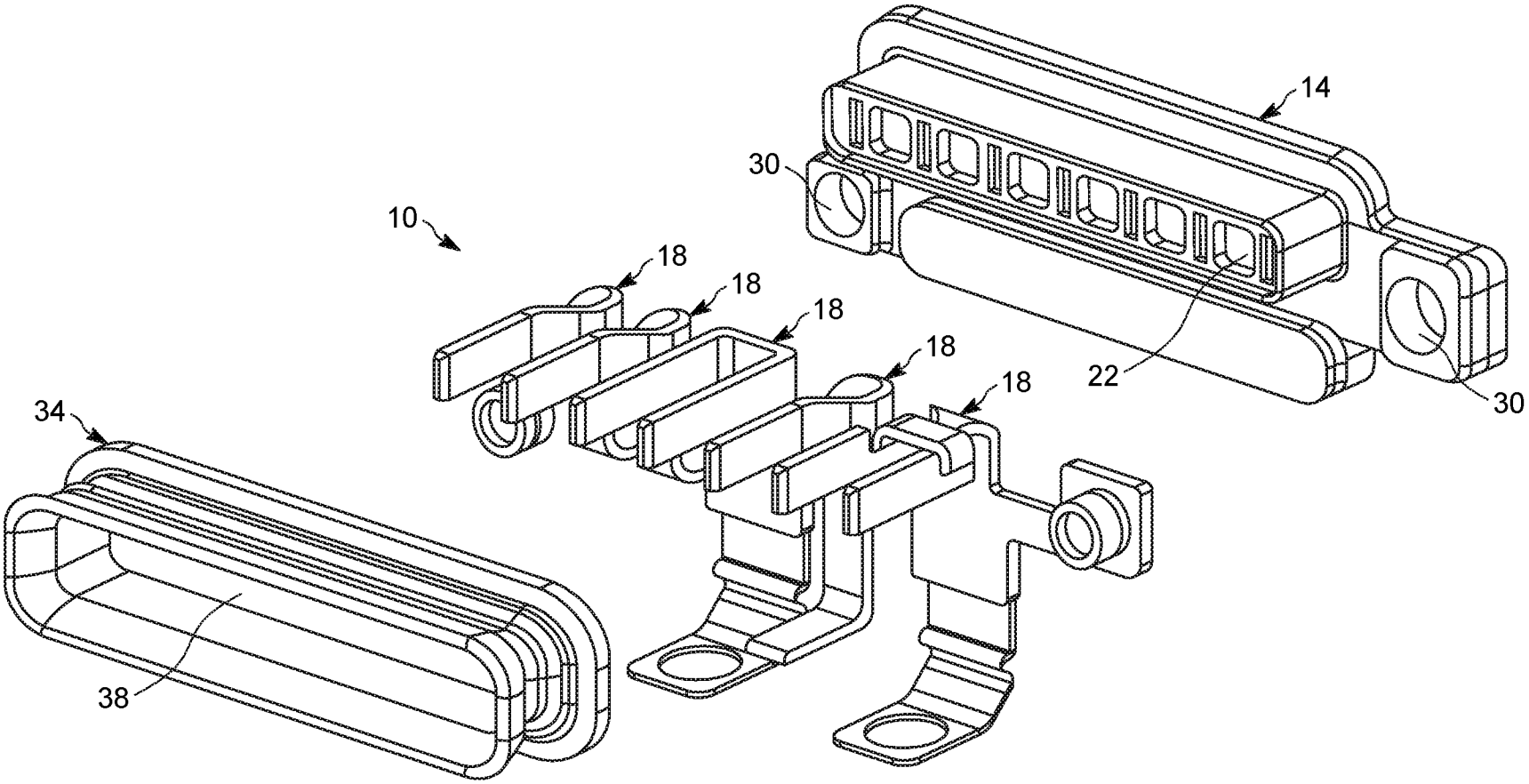
FIGS. 2 and 3 are front and rear perspective exploded views, respectively, of the connector assembly.
Figure 3:
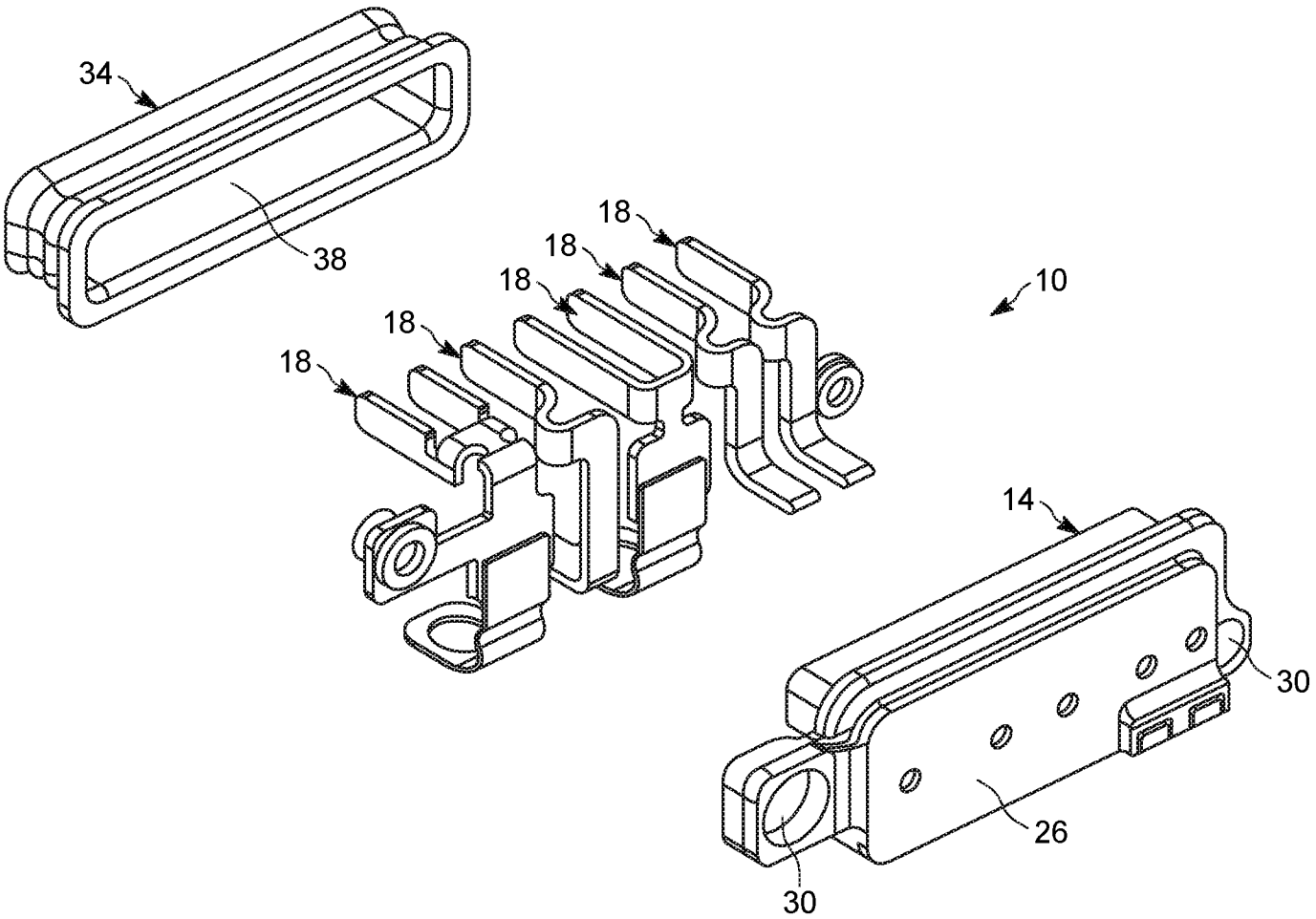
Figure 4:
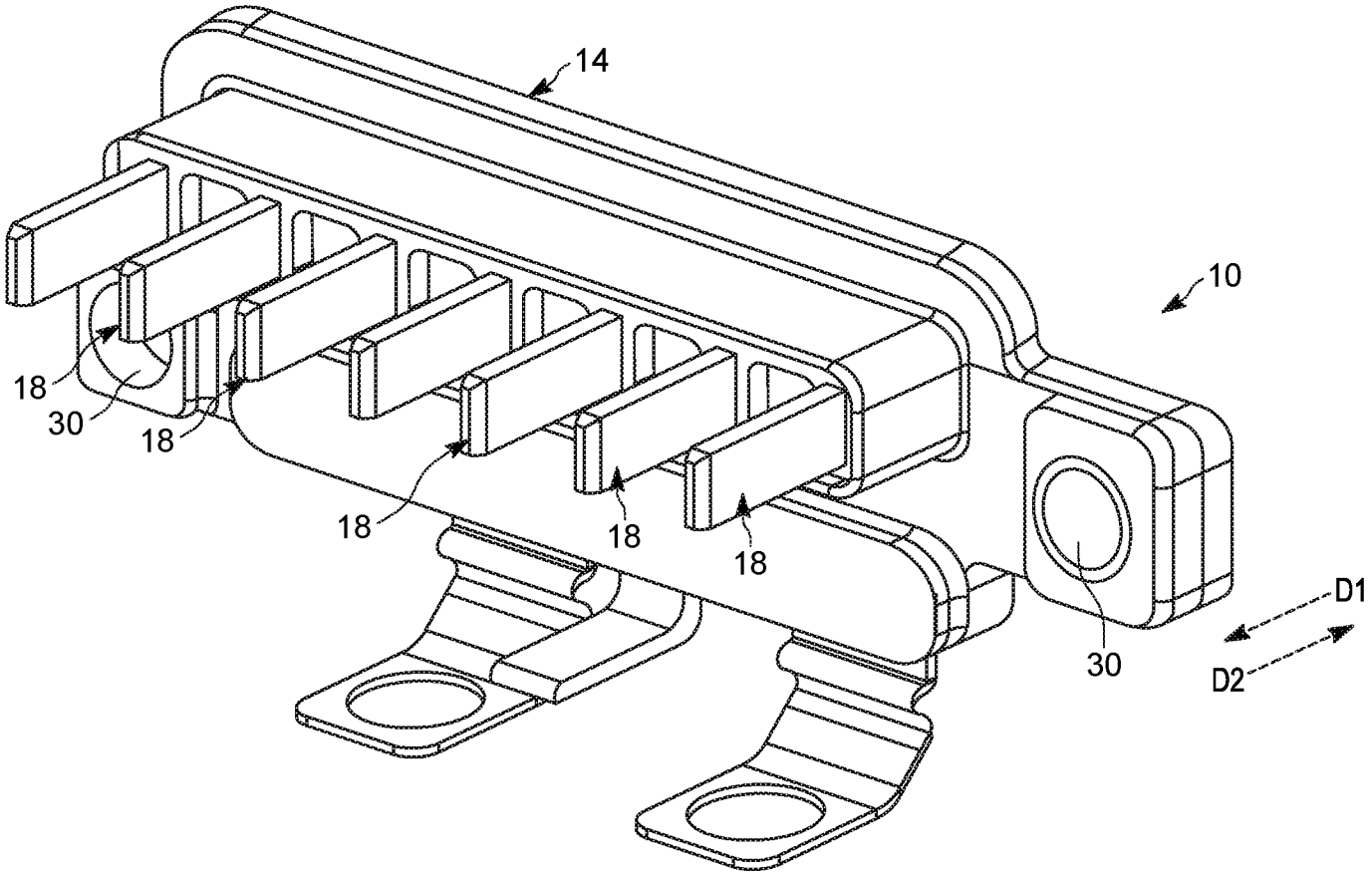
FIG. 4 is a perspective view of a portion of the connector assembly, illustrating a housing and sheet metal contacts extending through the housing.

With continued reference to FIGS. 1-3, in the illustrated embodiment the connector assembly 10 further includes a seal 34 coupled to the housing 14. The seal 34 has a generally oval shape, and defines an opening 38. In some embodiments, the seal 34 is an elastomeric, flexible seal 34. When assembled, the sheet metal contacts 18 extend through the opening 38 of the seal 34. Other embodiments include different shapes and sizes of a seal 34 than that illustrated.

Figure 5:
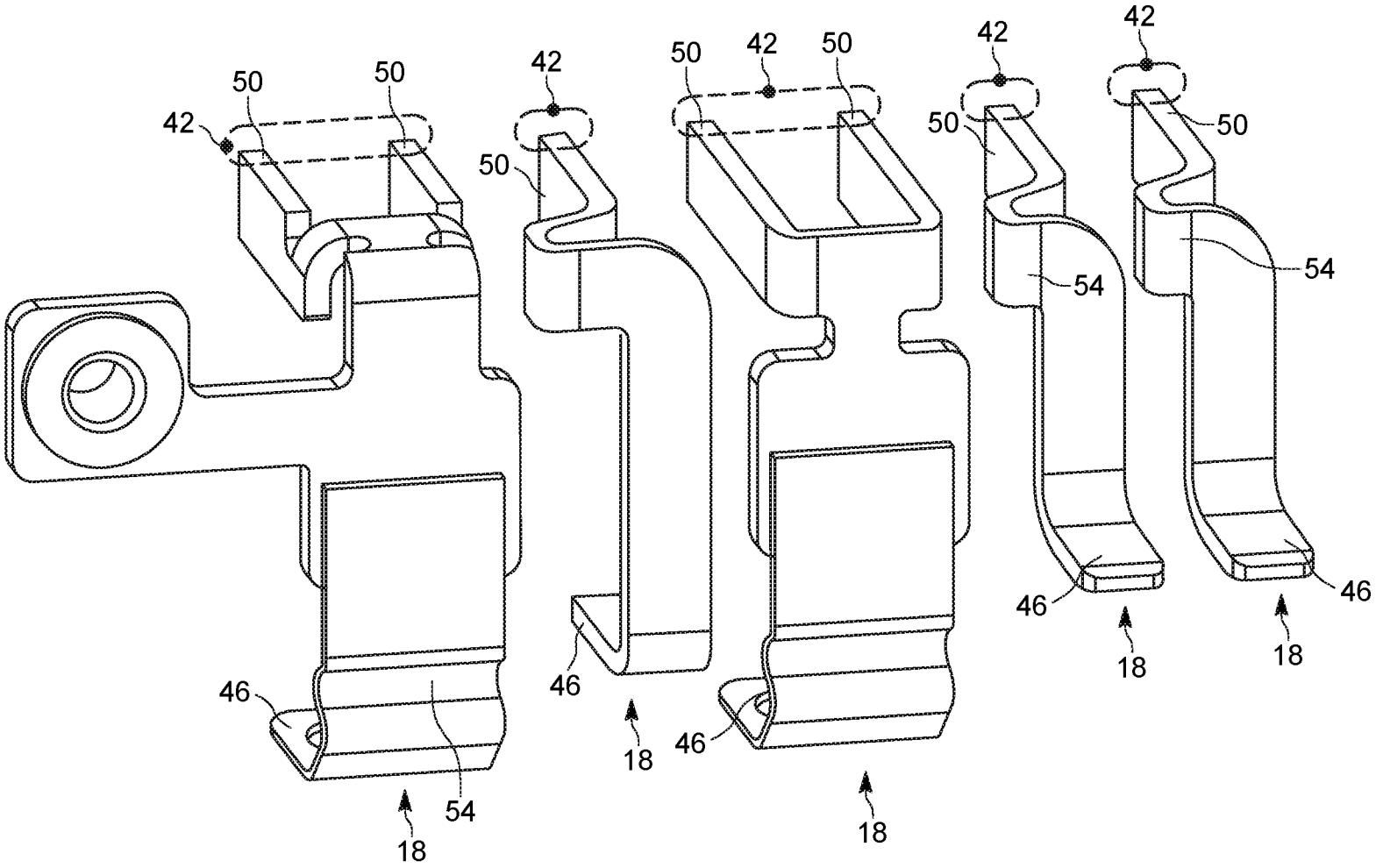
FIGS. 5 and 6 are perspective views of the sheet metal contacts.
Figure 6:
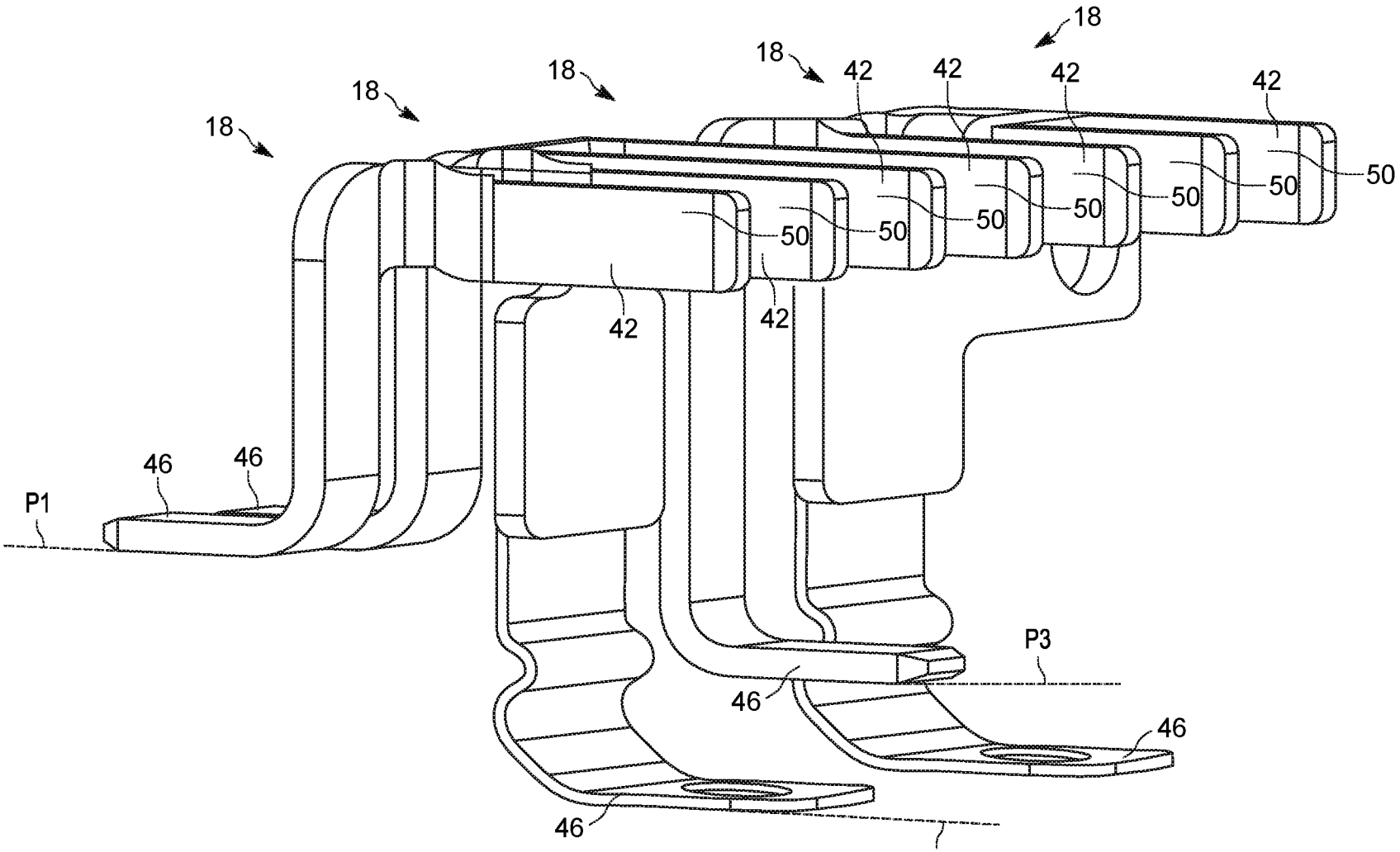
Figure 7:
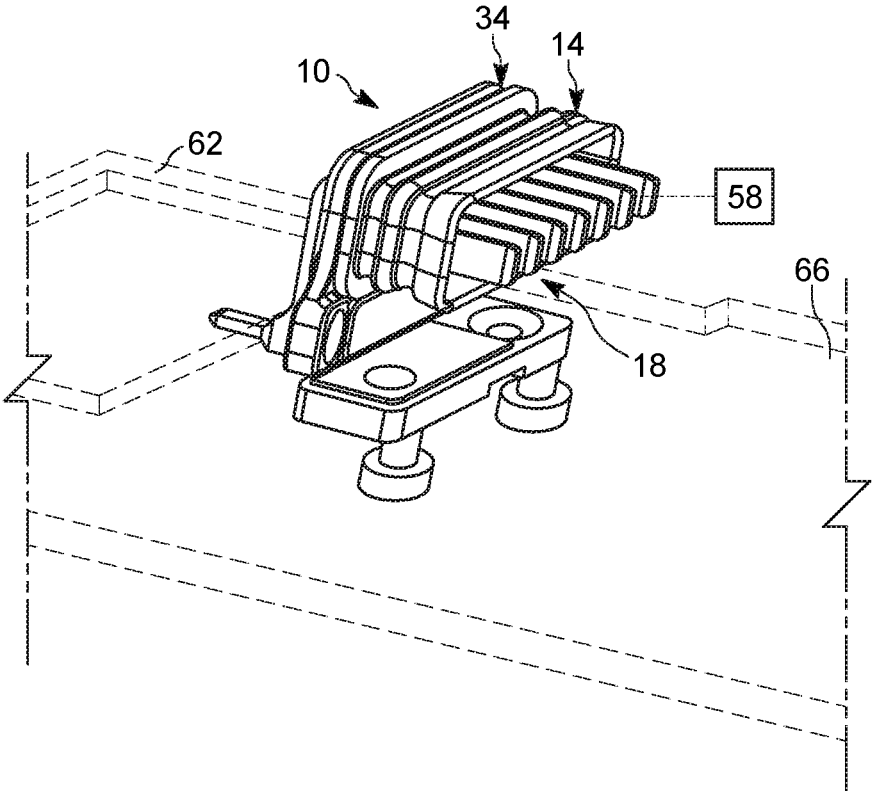
FIGS. 7-9 are perspective views illustrating the connector assembly coupled to different electrical components within an electronic device.
Figure 8:
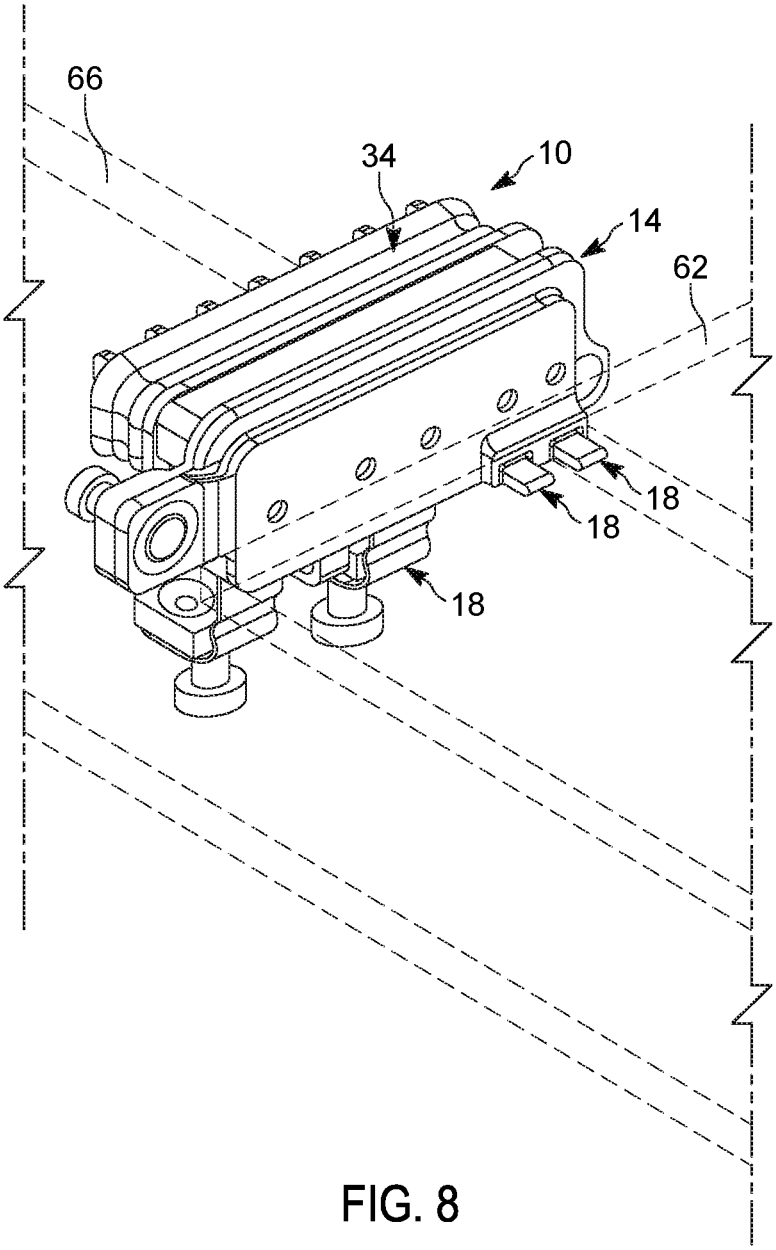
Figure 9:
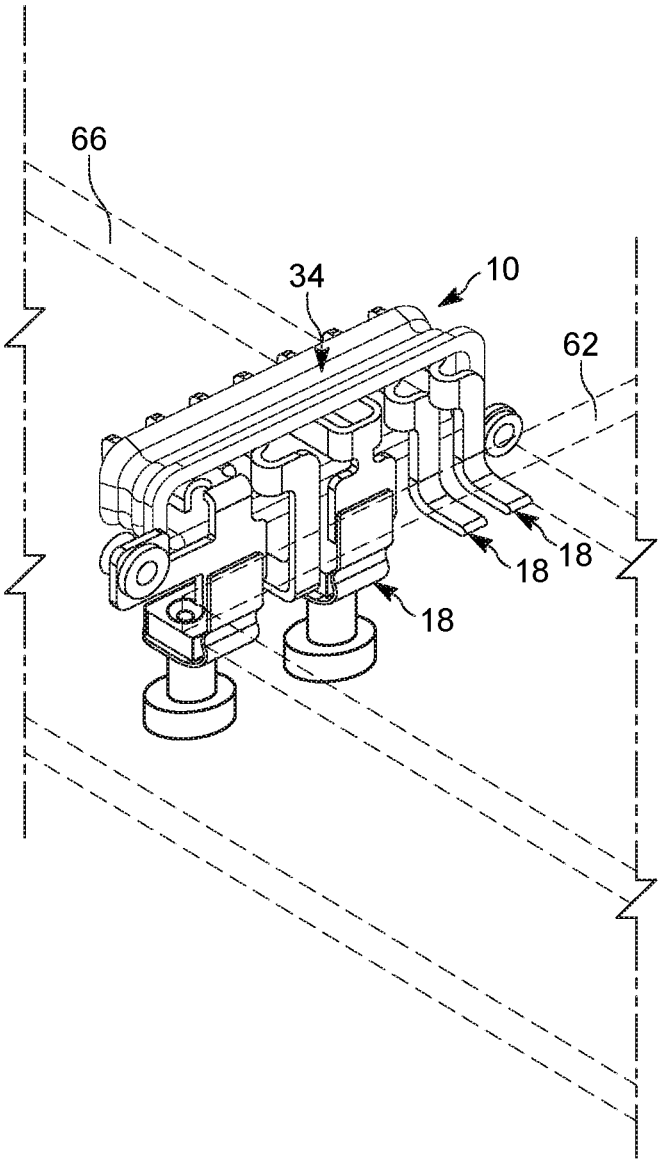

With reference to FIGS. 5 and 6, the illustrated embodiment includes five separate sheet metal contacts 18, although other embodiments may include different numbers (for example three, four, six, seven, and the like). Each of the sheet metal contacts 18 includes a battery contact region 42 to physically connect with a battery. Each of the sheet metal contacts 18 also includes an internal contact region 46 spaced from the battery contact region 42. The internal contact regions 46 are configured to physically contact electrical components (for example within a portable radio) and for example to establish electrical connections between the battery and the electrical components.

With reference to FIGS. 1-6, in the illustrated embodiment the sheet metal contacts 18 are bladed contacts. For example, some of the battery contact regions 42 include a single blade 50 of sheet metal, or more than one blade 50 of sheet metal (for example two blades 50). Each of the battery contact regions 42, including any blades 50 thereof, is aligned parallel to each of the other battery contact regions 42 and its blades 50. The battery contact regions 42 each extend away from the housing 14 in a first direction D1 (FIG. 4), and are arranged to be inserted into a battery for installation and connection to the battery. In contrast, at least one of the internal contact regions 46 extends away from the housing 14 in a second direction D2 (FIG. 4) that is different than (for example opposite) the first direction, and at least another of the internal contact regions 46 extends away from the housing 14 in the first direction. In yet other embodiments, each of the internal contact regions 46 may extend away from the housing 14 in the second direction, or may extend from the housing 14 in the first direction. In some embodiments one or more of the internal contact regions 46 may extend in a direction different than D1 or D2.

With reference to FIGS. 5 and 6, each of the sheet metal contacts 18 may have a profile that facilitates a spring-like force at the internal contact region 46. For example, the sheet metal contacts 18 may have generally L-shaped profiles, or J-shaped profiles, that extend away from the battery contact regions 42 and that include the internal contact region 46. These profiles allow the internal contact regions 46, or at least portions thereof, to bend and be pressed and retained against the electrical components (for example to establish an electrical connection). As illustrated in FIG. 5, in some embodiments one or more areas of the sheet metal contact 18 may include a bend, or fold 54 (for example a U-shaped region or bent region), to further facilitate the spring-like force.

With reference to FIGS. 6-12, at least one of the internal contact regions 46 is offset relative to another of the internal contact regions 46, so that the connector assembly 10 may connect to various different electrical components. For example, the connector assembly 10 may connect a battery 58 (illustrated schematically in FIG. 7) to both to a first printed circuit board 62 (or to an electrical component on the first printed circuit board 62) as well as to a second printed circuit board 66. As illustrated in FIGS. 7-12, the first printed circuit board 62 is generally elevated relative to the second printed circuit board 66.

To make the a connection, one or more of the internal contact regions 46 may extend in a first spatial plane P1 (FIGS. 6 and 10), one or more of the internal contact regions 46 may extend in a second spatial plane P2 (FIGS. 6, 11 and 12) that is lower than the first spatial plane P1, and one or more of the internal contact regions 46 may extend in a third spatial plane P3 (FIGS. 6 and 11) that is between the first spatial plane P1 and the second spatial plane P2. In yet other embodiments the internal contact regions 46 may extend to only two different planes (for example planes P1 and P2), or may extend to more than three different spatial planes. Additionally, while two of the internal contact regions 46 extend to the first spatial plane P1 and two of the internal contact regions 46 extend to the second spatial plane P2 in the illustrated embodiment, in other embodiments only a single internal contact region 46 may extend to the first spatial plane P1, and/or only a single internal contact region 46 may extend to the second spatial plane P3. In some embodiments, multiple internal contact regions 46 extend to the third spatial plane P3. In the illustrated embodiment the first spatial plane P1, the second spatial plane P2, and the third spatial plane P3 are parallel to one another, although in other embodiments one or more of these planes may not be parallel to the others. Other embodiments include various other arrangements and configurations other than that illustrated.

With continued reference to FIGS. 7-12, in the illustrated embodiment the blades 50 of the battery contact regions 42 each generally extend in a plane that is perpendicular to each of the spatial planes P1, P2, and P3. Thus, a first sheet metal portion of the sheet metal contact 18 may extend in a first plane, and a second sheet metal portion may extend in a second plane that is perpendicular to the first plane. In other embodiments the blades 50 of the battery contact regions 42 may extend, for example, in a plane that is parallel to the spatial plane P1, P2, and/or P3.

Figure 10:
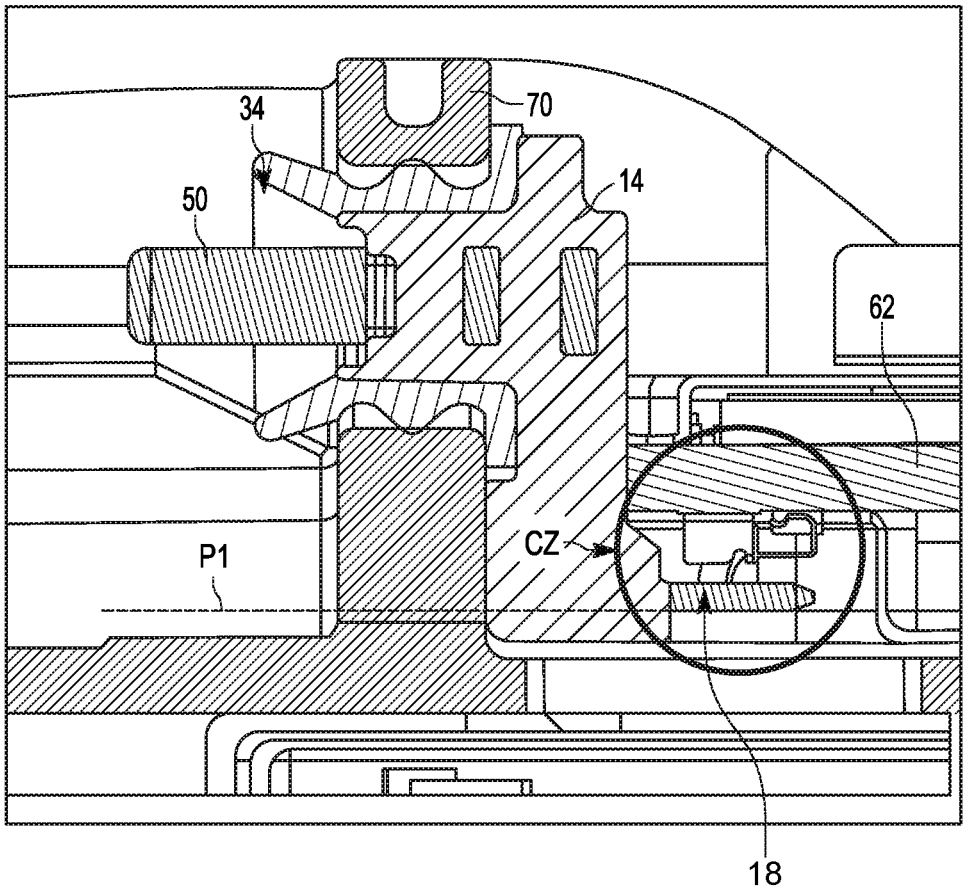
FIGS. 10-12 are cross-sectional views illustrating the connector assembly coupled to the different electrical components.
Figure 11:
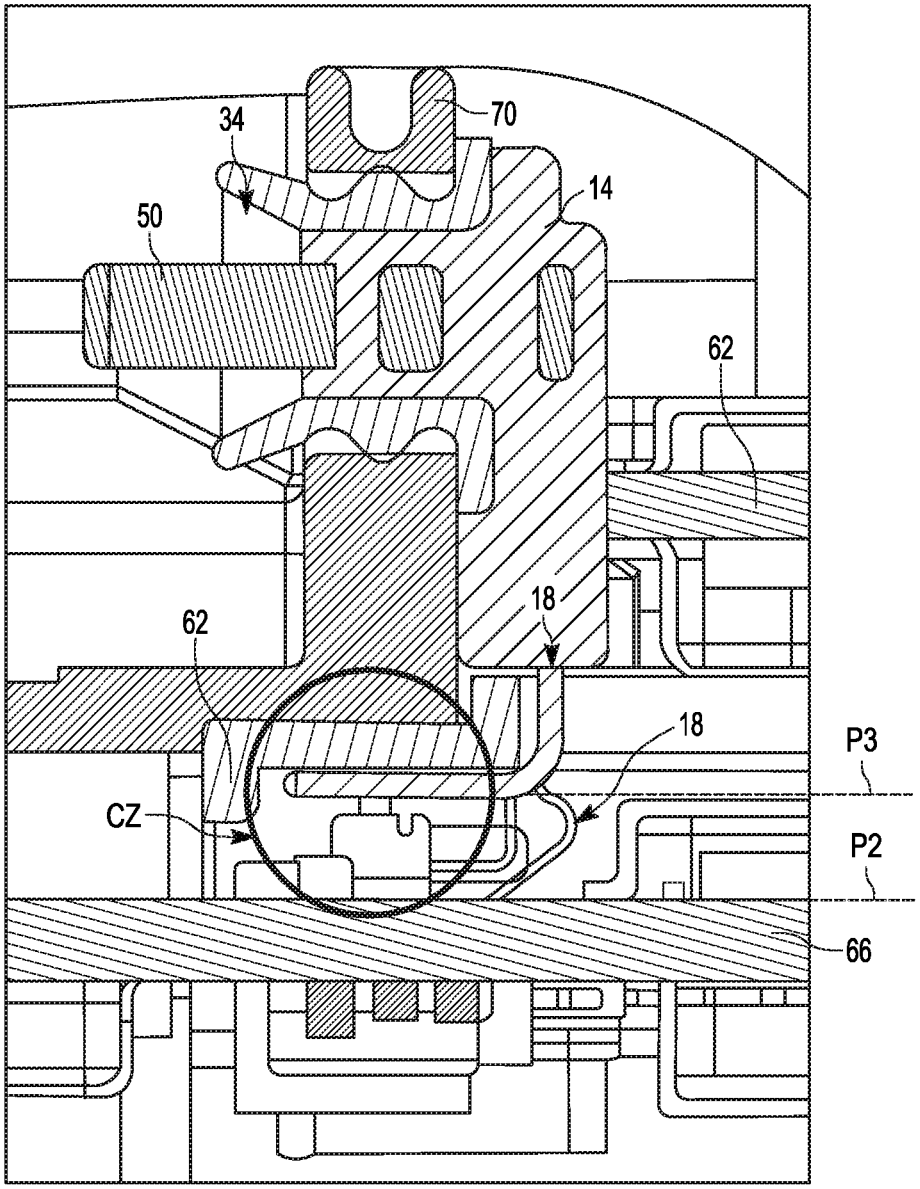
Figure 12:
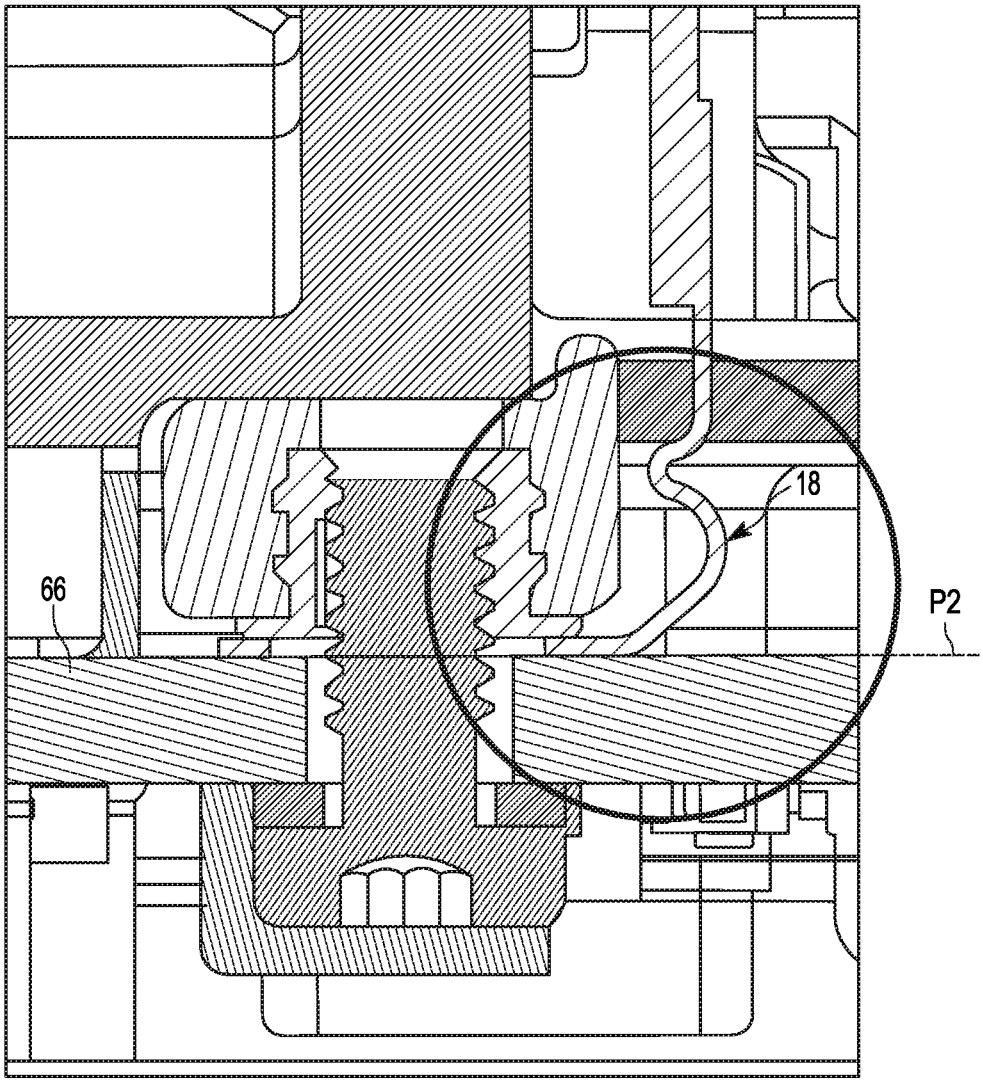

With reference FIGS. 10 and 11, during use the housing 14 of the connector assembly 10 may be initially fixed with fasteners to an interior housing 70 of an electronics device (for example a portable radio). For example, fasteners may be extended through the apertures 30 of the housing 14 to fix the interior housing 70 in place. By fixing the housing 14 in place, some of the internal contact regions 46 may thereby automatically be pressed against the first printed circuit board 62 or the second printed circuit board 66, or to another electrical component coupled thereto (for example see the connection zones "CZ" illustrated in FIGS. 10 and 11 illustrating where the internal contact regions 46 may be coupled). As described above, the sheet metal contacts 18 may have a spring-like force. Thus, it is not necessary that the internal contact regions 46 are perfectly aligned with a printed circuit board or other electrical component at first. Rather, the connector assembly 10 may rely on the flexibility and spring-like nature of the sheet metal contacts 18 to facilitate a connection after the interior housing 70 has been fixed in place.

With reference to FIG. 10, when the housing 14 of the connector assembly 10 is fixed to the interior housing 70, the seal 34 also forms a water-tight seal up against the interior housing 70. As illustrated in FIG. 10, the blades 50 of the battery contact regions 42 are thus exposed to the outside of the electrical device (for example to weather conditions such as rain), whereas the first and second printed circuit boards 62, 66 and the internal contact regions 46 are sealed off in in a dry area within the electrical device.

Figure 13:
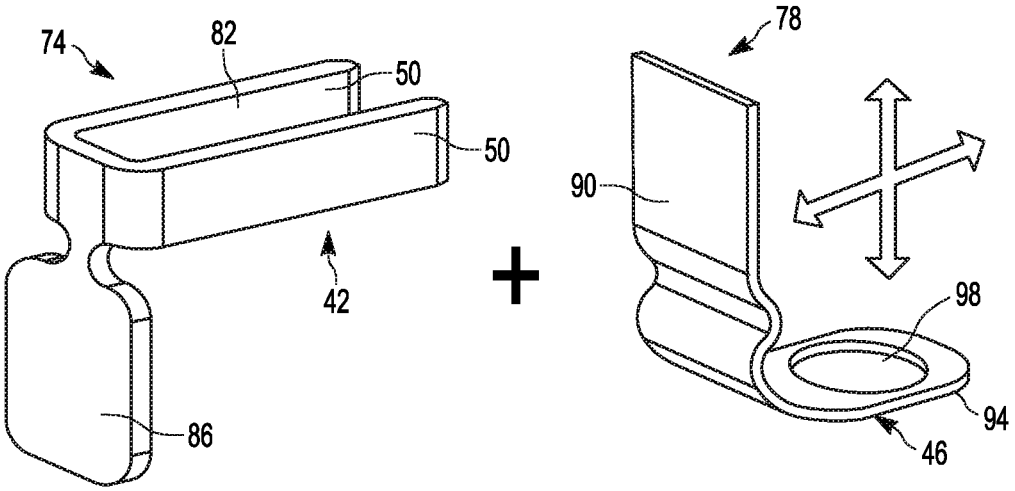
FIG. 13 is an exploded view of a two-piece sheet metal contact of the connector assembly.
Figure 14:
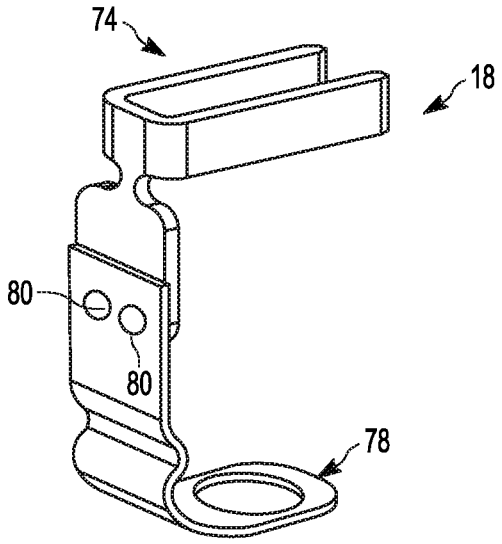
FIG. 14 is a perspective view of the two-piece sheet metal contact of FIG. 13.

With reference to FIGS. 13 and 14, in some embodiments one or more of the sheet metal contacts 18 may include a two-piece structure to further aid in flexibility and connection, as well as to improve flow of current between the battery 58 and the electrical component. For example, the sheet metal contact 18 may include a thicker, first sheet metal portion 74 (first sheet metal piece) that includes a battery contact region 42 with multiple thick blades 50, and a thinner, second sheet metal portion 78 (second sheet metal piece) that includes the internal contact region 46. The first sheet metal portion 74 and the second sheet metal portion 78 may be welded together at weld joints 80. For example, the first sheet metal portion 74 may include a first end 82 and a second end 86, and the second portion 78 may include a first end 90 and a second end 94. The first end 82 of the first sheet metal portion 74 may include the blades 50, and the second end 94 of the second sheet metal portion 78 may include an aperture 98. The second end 86 of the first sheet metal portion 74 may be welded to the first end 90 of the second sheet metal portion 78 at the weld joints 80.

The first sheet metal portion 74 may have a U-shaped profile that includes the two blades 50. The second portion 78 may have, for example, an L-shaped profile or other shaped profile, and may include the aperture 98. A fastener (for example screw) may be passed through the aperture 98 to fasten and secure the second portion 78 to an electrical component. The second portion 78 may be flexible in multiple directions (as illustrated by arrows in FIG. 13). This two-piece arrangement allows high current to flow through both the first sheet metal portion 74 and the second sheet metal portion 78. In other embodiments one or more of the sheet metal contacts 18 may be a single sheet metal piece (for example of constant thickness), and may also include an aperture 98 that may be used to help secure the internal contact region 46 against an electrical component. Securing the internal contact region 46 with a screw or other fastener may help to reduce an overall impedance of the connector assembly 10.

Figure 15:
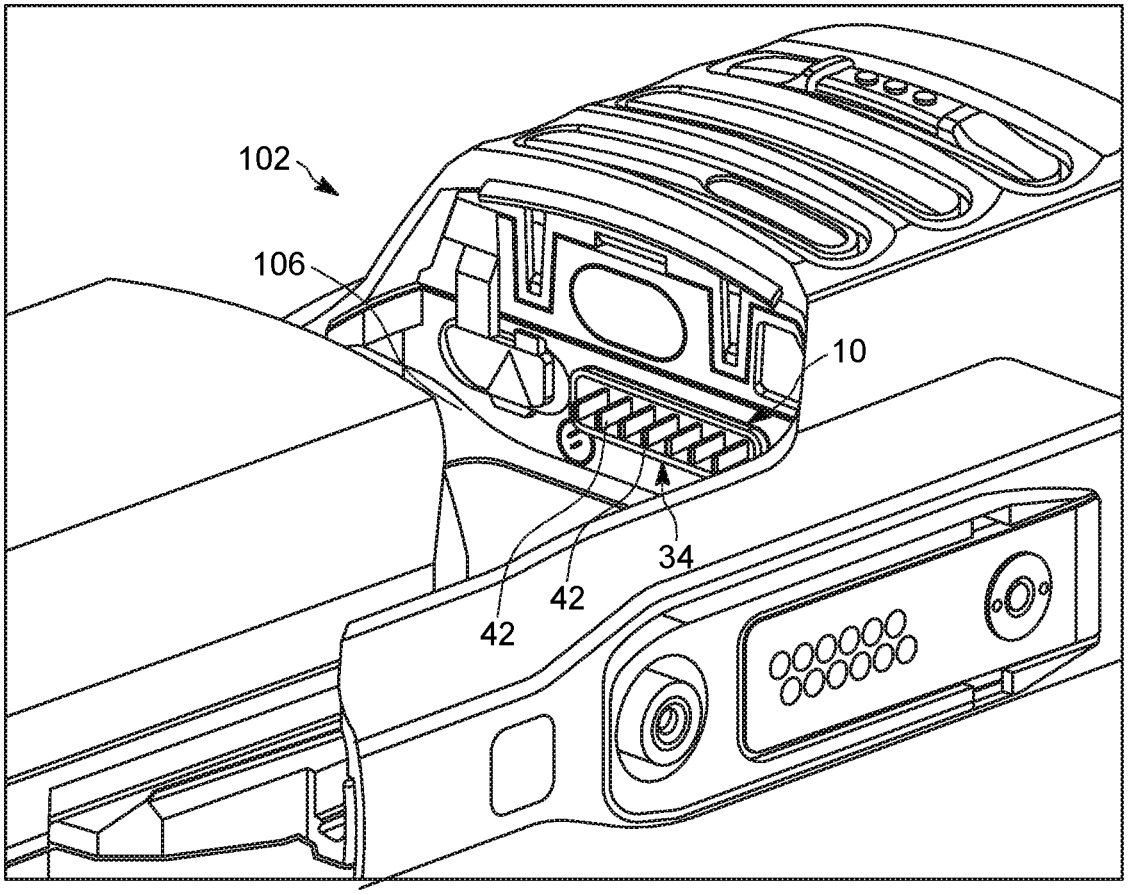
FIG. 15 is a perspective view of the connector assembly of FIG. 1 installed on a portable radio.

With reference to FIG. 15, in some embodiments the connector assembly 10 may be installed within a portable radio 102, such that the battery contact regions 42 project into a battery compartment 106 of the portable radio 102. As illustrated in FIG. 15, at least a portion of the seal 34 may also project into the battery compartment 106. Other embodiments include different arrangements than that illustrated, and installation of the connector assembly 10 into different electronic devices other than a portable radio 102.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A connector assembly for connecting a battery to a plurality of different electrical components within an electrical device, the connector assembly comprising:

a housing;

a plurality of sheet metal contacts coupled to and extending through the housing, the plurality of sheet metal contacts defining a plurality of battery contact regions and a plurality of internal contact regions spaced form the plurality of battery contact regions, the plurality of internal contact regions configured to physically contact the plurality of different electrical components; and wherein a first one of the plurality of internal contact regions is offset from a second one of the plurality of internal contact regions in a different spatial plane than a spatial plane of the second one of the plurality of internal contact regions.

2. The connector assembly of claim 1, wherein each of the plurality of battery contact regions extends away from the housing in a first direction.

3. The connector assembly of claim 2, wherein the plurality of battery contact regions extend parallel to one another.

4. The connector assembly of claim 2, wherein at least one of the plurality of internal contact regions extends away from the housing in a second direction that is different than the first direction.

5. The connector assembly of claim 4, wherein at least another of the plurality of internal contact regions extends away from the housing in the first direction.

6. The connector assembly of claim 1, wherein a first one of the plurality of internal contact regions extends in a first spatial plane, a second one of the plurality of internal contact regions extends in a second spatial plane, and a third one of the plurality of internal contact regions extends in a third spatial plane, wherein the first spatial plane, the second spatial plane, and the third spatial plane are each offset from one another.

7. The connector assembly of claim 1, wherein at least one of the plurality of internal contact regions includes an aperture configured to receive a fastener.

8. The connector assembly of claim 1, wherein the plurality of sheet metal contacts includes at least five separate sheet metal contacts each coupled to the housing.

9. The connector assembly of claim 1, wherein at least one of the plurality of sheet metal contacts includes a first sheet metal portion having a first thickness, and a second sheet metal portion having a second thickness less than the first thickness, wherein the first sheet metal portion is welded to the second sheet metal portion.

10. The connector assembly of claim 9, wherein the first sheet metal portion includes one of the plurality of battery contact regions, and the second sheet metal portion includes one of the plurality of internal contact regions.

11. The connector assembly of claim 1, wherein at least one of the plurality of battery contact regions includes a U-shaped region.

12. The connector assembly of claim 1, wherein at least one of the plurality of sheet metal contacts includes a bent region to provide flexibility.

13. The connector assembly of claim 1, wherein at least one of the plurality of sheet metal contacts includes a first sheet metal portion that extends in a first plane, and a second sheet metal portion that extends in a second plane that is perpendicular to the first plane.

14. The connector assembly of claim 13, wherein the first sheet metal portion includes one of the plurality of battery contact regions, and the second sheet metal portion includes one of the plurality of internal contact regions.

15. The connector assembly of claim 1, wherein the housing is overmolded onto the plurality of sheet metal contacts and includes an aperture for receiving a fastener to fasten the housing to a portion of the electrical device.

16. The connector assembly of claim 15, further comprising a seal coupled to the housing, the seal having an aperture, wherein the plurality of battery contact regions extend through the aperture.

17. The connector assembly of claim 1, wherein each of the plurality of battery contact regions is a fixed, stationary blade configured to contact a battery.

18. The connector assembly of claim 17, wherein each blade is configured to be contacted by the battery on opposite sides of the blade.

19. The connector assembly of claim 1, wherein the plurality of internal contact regions includes at least one internal contact region that is a flexible spring configured to press against one of the plurality of different electrical components.

20. The connector assembly of claim 9, wherein the first sheet metal portion has a U-shaped region.

21. The connector assembly of claim 1, wherein the first one of the plurality of internal contact regions is in a first horizontal plane, and the second one of the plurality of internal contact regions is in a second horizontal plane offset from the first horizontal plane.

22. A connector assembly for connecting a battery to an electrical component within an electrical device, the connector assembly comprising:

a housing;

a two-piece sheet metal contact coupled to and extending through the housing, the two-piece sheet metal contact having:

a first sheet metal piece having a first thickness, a first end, and a second end, wherein the first end of the first sheet metal piece is configured physically connect to a battery within the electrical device; and a second sheet metal piece having a second thickness that is less than the first thickness, wherein the second sheet metal piece is welded to the second end of the first sheet metal piece, wherein the second sheet metal piece is configured to physically connect to the electrical component within the electrical device.

23. The connector assembly of claim 22, wherein the first sheet metal piece includes a U-shaped region.

24. The connector assembly of claim 22, wherein the second sheet metal piece has an L-shaped profile.

25. The connector assembly of claim 22, wherein the second sheet metal piece includes an aperture configured to receive a fastener.

* * * * *